US011624040B2

(12) United States Patent
Han

(10) Patent No.: US 11,624,040 B2
(45) Date of Patent: Apr. 11, 2023

(54) REMOTE CONTROLLABLE AUTO-IGNITION CANDLE AND CONTROL SYSTEM THEREOF

(71) Applicant: Samyoung Machinery Co., Ltd., Gongju-Si (KR)

(72) Inventor: Kuk Hyun Han, Daejeon (KR)

(73) Assignee: SAMYOUNG MACHINERY CO., LTD., Gongju-Si (KR)

( * ) Notice: Subject to any disclaimer, the term of this patent is extended or adjusted under 35 U.S.C. 154(b) by 287 days.

(21) Appl. No.: 15/699,924

(22) Filed: Sep. 8, 2017

(65) Prior Publication Data

US 2018/0072965 A1 Mar. 15, 2018

(30) Foreign Application Priority Data

Sep. 9, 2016 (KR) ..... 10-2016-0116307

(51) Int. Cl.

| | |
|---|---|
| ***C11C 5/00*** | (2006.01) |
| ***F23Q 25/00*** | (2006.01) |
| ***F23Q 21/00*** | (2006.01) |
| ***F23Q 3/00*** | (2006.01) |

(52) U.S. Cl.

CPC ..... *C11C 5/006* (2013.01); *C11C 5/008* (2013.01); *F23Q 3/006* (2013.01); *F23Q 21/00* (2013.01); *F23Q 25/00* (2013.01)

(58) Field of Classification Search

CPC ..... C11C 5/006; C11C 5/008; C11C 5/002; F23D 3/08; F23D 3/18; F23D 3/16; F23D 2900/03082; F23D 3/24; F23D 3/20; F23D 3/36; F23D 3/38; F23B 2900/00003; F23C 2900/99008; F24V 30/00

See application file for complete search history.

(56) References Cited

U.S. PATENT DOCUMENTS

| | | | | |
|---|---|---|---|---|
| 2002/0146656 | A1* | 10/2002 | Thigpen | F21S 13/12 431/253 |
| 2009/0214996 | A1* | 8/2009 | Putrello | F23Q 1/06 431/273 |
| 2012/0148966 | A1 | 6/2012 | Ramaker et al. | |
| 2013/0317651 | A1* | 11/2013 | Huang | F24C 3/00 700/274 |

(Continued)

FOREIGN PATENT DOCUMENTS

| | | | |
|---|---|---|---|
| JP | 08041487 A | * | 2/1996 |
| JP | 10168481 A | * | 6/1998 |

OTHER PUBLICATIONS

English translation of Namiki.*

*Primary Examiner* — Jason Lau

(74) *Attorney, Agent, or Firm* — STIR Law Group, LLC

(57) ABSTRACT

Provided are a remote controllable auto-ignition candle and a control system thereof, and more particularly, a remote controllable auto-ignition candle including a wick portion performing combustion after ignition and including a wick made of a conductive material; a first communication unit communicating with a user terminal in a wired or wireless manner; a control unit controlling an ignition state of the wick portion according to a control signal received through the first communication unit; and an ignition means generating a discharge to the wick so that the wick portion is ignited according to a control of the control unit.

22 Claims, 14 Drawing Sheets

(56) References Cited

U.S. PATENT DOCUMENTS

| | | | | |
|---|---|---|---|---|
| 2014/0205272 | A1* | 7/2014 | Midgette | A01M 1/2077<br>392/395 |
| 2015/0102731 | A1* | 4/2015 | Altamura | H05B 33/0821<br>315/152 |

* cited by examiner

REMOTE CONTROLLABLE AUTO-IGNITION CANDLE AND CONTROL SYSTEM THEREOF

CROSS-REFERENCE TO RELATED APPLICATIONS

This application claims priority under 35 U.S.C. § 119 to Korean Patent Application No. 10-2016-0116307, filed on Sep. 9, 2016, in the Korean Intellectual Property Office, the disclosure of which is incorporated herein by reference in its entirety.

TECHNICAL FIELD

The following disclosure relates to a remote controllable auto-ignition candle and a control system thereof.

BACKGROUND

A candle may provide a warm and special mood as a natural light source unlike an artificial light source such as electric lighting, and has additional advantages such as deodorization, fragrance, and the like, such that use of the candle has gradually increased. The candle is lighting fuel manufactured by molding combustible solids such as paraffin and beeswax, and inserting a wick into the center of the candle. In the case of lighting the wick, the candle is melted, and the melted candle rises upwardly along the wick by a capillary phenomenon to thereby be vaporized and combusted at a distal end portion of the wick, such that a flame burns. A combustion temperature of a surface flame of the candle is 1400° C. or more, a temperature of a lightest inner flame thereof is 1200° C. or more, and a temperature of a flame center thereof is 400 to 900° C.

In order to light the wick of the candle, a separate ignition mechanism such as a match, a lighter, or the like, is required. This causes inconveniences at the time of using the candle, and in the case where there is no ignition mechanism, it is impossible to use the candle itself.

In addition, at the time of lighting the candle using the ignition mechanism, there is a risk of an external injury such as a burn.

To overcome the above problem, the present invention can automatically ignite by a remote control to improve convenience and safety of use.

Even if a user goes out while carelessly igniting a candle, automatic fire extinguishing is also possible by a remote control, which can lead to minimizing disadvantages of using a candle.

In this regard, a wick of a candle having a cross (+) shape in which the wick of a candle is perpendicularly oriented has been disclosed in U.S. Patent Application Publication No. 2012-0148966. In this case, the wick of a candle may be supported in an upright manner through the cross (+) shape, but similarly to the related art, the candle may be lighted only by a separate ignition mechanism.

RELATED ART DOCUMENT

Patent Document

U.S. Patent Application Publication No. 2012-0148966

SUMMARY

An object of the present invention is to provide a remote controllable auto-ignition candle and a control system thereof.

In one general aspect, a remote controllable auto-ignition candle includes: a wick portion performing combustion after ignition and including a wick made of a conductive material; a first communication unit communicating with a user terminal in a wired or wireless manner; a control unit controlling an ignition state of the wick portion according to a control signal received through the first communication unit; and an ignition means generating a discharge to the wick so that the wick portion is ignited according to a control of the control unit.

The wick portion may include at least two wicks spaced apart from each other.

The remote controllable auto-ignition candle may further include: an electrode positioned at a lower end of the wick and electrically connected to the wick, wherein the ignition means may apply a voltage to the electrode.

The ignition means may generate at least one of an arc discharge, a spark discharge, a corona discharge, and a glow discharge.

The at least two wicks may be disposed to face each other.

If the number of wicks is an even number, wicks connected to electrodes having different polarities may be positioned to face each other while being adjacent to each other.

If the number of wicks is an odd number, wicks connected to electrodes having different polarities may be positioned to face each other while being adjacent to each other and one wick without a pair is not connected to an electrode and is positioned between a pair of wicks connected to the electrodes.

If the number of wicks is an odd number, a common electrode may be connected to one wick and an electrode having polarity different from that of the common electrode is connected to at least one wick adjacent to the one wick.

The remote controllable auto-ignition candle may further include: a sensor unit detecting temperature or light of the wick portion or detecting a gas concentration around the candle.

The control unit may determine an ignition state of the wick portion according to information of the temperature or light detected by the sensor unit.

The control unit may notify a warning message to the terminal or issue an alarm thereto if it is determined that the gas concentration detected by the sensor unit is equal to or higher than a predetermined value.

The remote controllable auto-ignition candle may further include: a power supply supplying operating power to the control unit, the ignition means, and the first communication unit.

The power supply may be supplied with power from the outside in a wired manner.

The power supply may include a battery.

The battery may be charged in a wired or wireless manner if the battery is a secondary battery that is recharged to be reused.

In another general aspect, a control system of a remote controllable auto-ignition candle, includes: at least one auto-ignition candle of any one of claims 1 to 15; and the terminal controlling the auto-ignition candle in a wired or wireless manner.

The terminal may include: an input unit receiving control information for an ignition control of the auto-ignition candle from a user; and a second communication unit transmitting the control information received from the input unit to the auto-ignition candle.

The control information may be at least one of an ignition on/off control of the auto-ignition candle, a brightness control, an ignition time control, an ignition pattern control of the wick portion, and a selection control of the auto-ignition candle.

If the auto-ignition candle receives the control information regarding the ignition-on control from the terminal, the control unit of the auto-ignition candle may control the ignition means to control the ignition of the wick.

The wick portion may include at least three wicks spaced apart from each other, and if the auto-ignition candle receives the control information regarding the brightness control from the terminal, the control unit of the auto-ignition candle may control the ignition means to control the number of wicks to be ignited.

The wick portion may include at least three wicks spaced apart from each other, and if the auto-ignition candle receives the control information regarding the ignition pattern control of the wick portion from the terminal, the control unit of the auto-ignition candle may control the ignition means to control the ignition pattern of the wick of the wick portion to be ignited.

The number of auto-ignition candles controlled by the terminal in a wired or wireless manner may be plural, and if at least one of the plurality of auto-ignition candles receives the control information regarding the selection control of the auto-ignition candle from the terminal, the at least one auto-ignition candle receiving the control information regarding the selection control of the auto-ignition candle may control the ignition means to perform the ignition-on or off control, the brightness control, the ignition time control, and the ignition pattern control of the wick portion.

The input unit may use an interactive interface previously stored in the terminal to derive control information for the ignition control of the auto-ignition candle based on characters received from a user.

The control information may be received by executing a control program of the auto-ignition candle previously installed in the terminal.

The control program may display and provide the form in which the wicks of each wick portion of the at least one auto-ignition candle are disposed, and the ignition pattern control of the wick portion may be performed by selecting a position of the wick to be ignited in the form.

The input unit may further receive status request information for monitoring the ignition state of the auto-ignition candle from the user.

If the status request information is received, the auto-ignition candle may transmit the status information regarding the ignition state of the wick to the terminal.

The auto-ignition candle may further include a fire extinguishing means for extinguishing the ignited wick.

If the auto-ignition candle receives the control information regarding the ignition-off control from the terminal, the control unit of the auto-ignition candle may control the fire extinguishing means to control the fire extinguishing of the wick.

If the auto-ignition candle receives the control information regarding the ignition time control from the terminal, the control unit of the auto-ignition candle may control the ignition means and the fire extinguishing means to control the ignition time of the wick.

The terminal may communicate with the auto-ignition candle through at least any one of Wi-Fi, Bluetooth, infrared communication, ZigBee, Z-wave, contactless local area communication, mobile network, low power wide area (LPWA), and a local area network (LAN).

The contactless local area communication may be radio-frequency Identification (RFID) or near-field communication (NFC).

The mobile network may be any one of 3G, LTE, LTE-M, and NB-IoT.

The LPWA may be any one of LoRa, SigFox, Weightless, and Ingenu schemes.

The terminal may be any one of a remote control unit, a mobile phone, a smart phone, a tablet PC, a smart watch, a wearable device, a notebook computer, or a personal computer (PC).

The control unit of the auto-ignition candle may control the ignition means in the moment that the first communication unit communicates with the terminal to start the connection to ignite the wick and the control unit may control the fire extinguishing means in the moment that the connection with the terminal is released to extinguish the wick.

Other features and aspects will be apparent from the following detailed description, the drawings, and the claims.

DETAILED DESCRIPTION OF MAIN ELEMENTS

Figure 1:
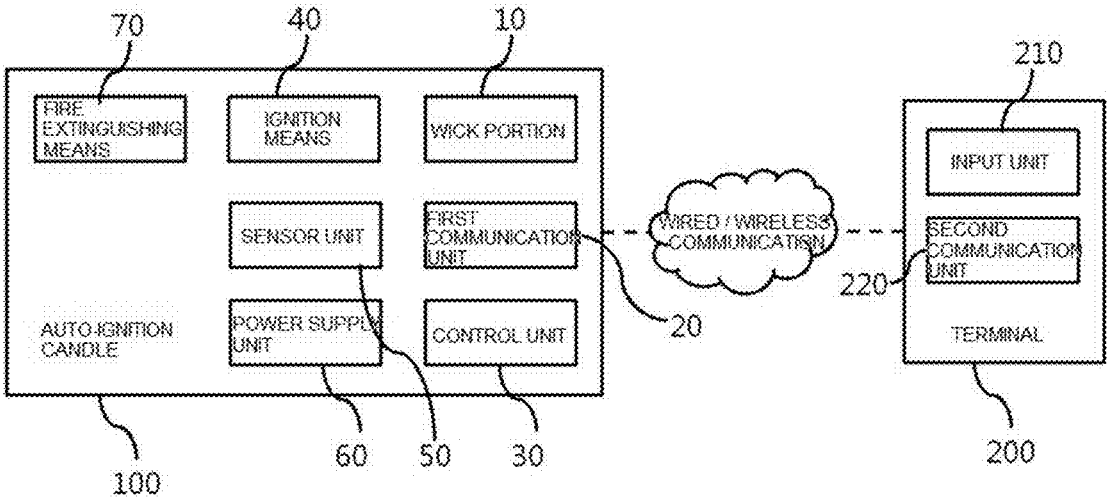
FIG. 1 is a configuration diagram illustrating a control system of a remote controllable auto-ignition candle according to an exemplary embodiment of the present invention.

100: Auto-ignition candle
10: Wick portion
20: First communication unit
30: Control unit
40: Ignition means
50: Sensor unit
60: Power supply unit
70: Fire extinguishing means
200: Terminal
210: Input unit
220: Second communication unit

DETAILED DESCRIPTION OF EMBODIMENTS

Hereinafter, a remote controllable auto-ignition candle and a control system thereof according to exemplary embodiments of the present invention will be described in detail with reference to the following accompanying drawings. The drawings to be introduced below are provided by way of example so that the idea of the present invention may be sufficiently transferred to those skilled in the art to which the present invention pertains. Accordingly, the scope of the present invention is not restricted to the following description and accompanying drawings. In addition, throughout the specification, like reference numerals denote like components.

Technical terms and scientific terms used in the present specification have the general meaning understood by those skilled in the art to which the present invention pertains unless otherwise defined, and a description for the known function and configuration unnecessarily obscuring the gist of the present invention will be omitted in the following description and the accompanying drawings.

In addition, the system means a set of components including apparatuses, mechanisms, units, etc. which are organized and regularly interact with each other to perform required functions.

As illustrated in FIG. 1, a control system of a remote controllable auto-ignition candle according to an exemplary embodiment of the present invention may be configured to include at least one remote controllable auto-ignition candle 100 and a terminal 200 for controlling the auto-ignition candle 100 in a wired or wireless manner.

The auto-ignition candle 100 and the terminal 200 may be preferably controlled while communicating through at least any one of Wi-Fi, Bluetooth, infrared communication, ZigBee, Z-wave, contactless local area communication, mobile network, low power wide area (LPWA), and a local area network (LAN).

As the contactless local area communication, radio-frequency Identification (RFID) or near-field communication (NFC) are preferably used.

As the mobile network, any one of 3G, LTE, LTE-M, and NB-IoT is preferably used, but the present invention is not limited thereto.

In addition, as low power long distance communication, any one of LoRA, SigFox, Weightless, and Ingenu is preferably used, but the present invention is not limited thereto.

Figure 10:
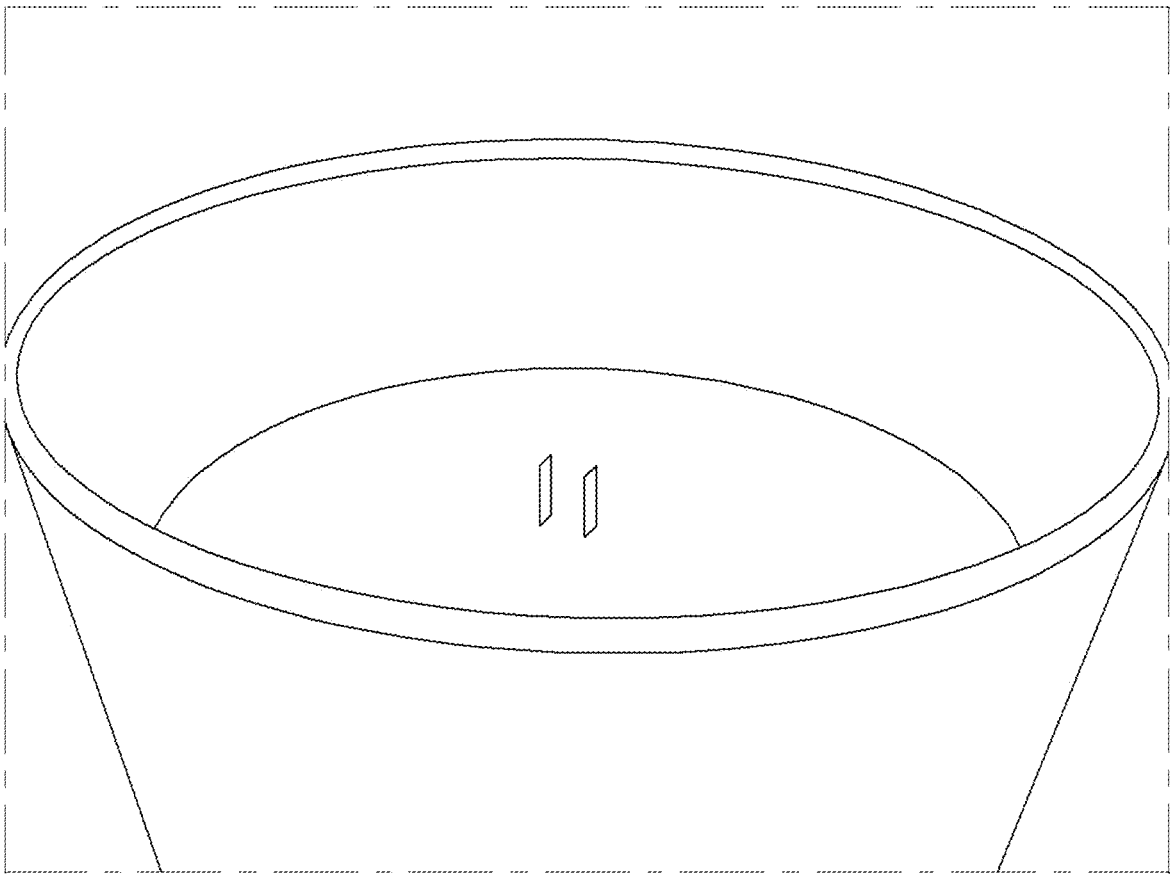
FIGS. 10 and 11 are photographs of an example of the remote controllable auto-ignition candle according to an exemplary embodiment of the present invention.
Figure 11:
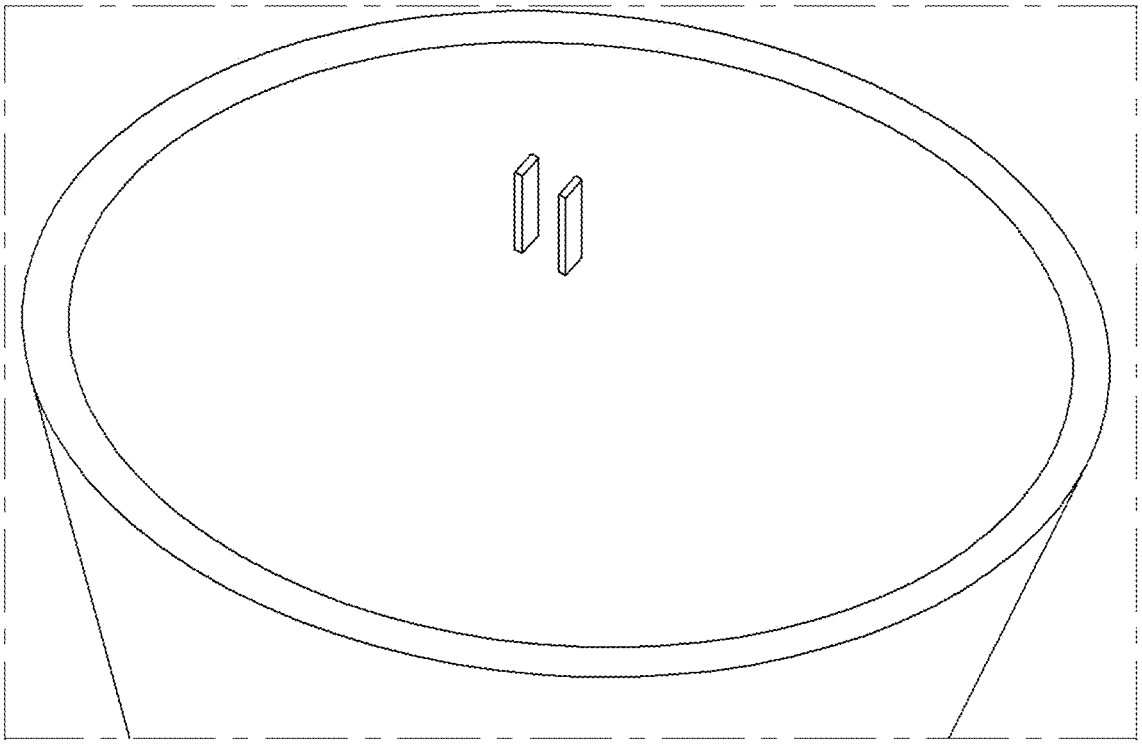

Above all, the remote controllable auto-ignition candle 100 will be described in detail. FIGS. 10 and 11 are photographs of an example of a remote controllable auto-ignition candle 100 according to an exemplary embodiment of the present invention.

The remote controllable auto-ignition candle 100 may be configured to include a wick portion 10, a first communication unit 20, a control unit 30, and an ignition means 40.

It is preferable that the wick portion 10 is combusted after ignition and includes a wick containing a conductive material. The wick is ignited by a discharge and thus may be directly ignited and combusted. At this time, the wick portion 10 is preferably configured to include two or more wicks spaced apart from each other.

Specifically, the wick portion 10 includes a wick having conductivity by containing a conductive material. At this time, when a direction in which the wick is combusted is referred to as a longitudinal direction of the wick, the wick may have conductivity at least in the longitudinal direction by the conductive material. Specifically, it is preferable that the wick is a conductive wick containing a conductive material to form a current moving path between both ends at least in a longitudinal direction of the wick.

The wick containing the conductive material of the wick portion 10 may have conductivity enough that a voltage applied to the wick is transmitted in the longitudinal direction of the wick to generate a discharge at one end of the wick in the longitudinal direction. Accordingly, the wick having conductivity enough to generate the discharge may be defined as a conductive wick.

That is, the wick portion 10 includes a wick having conductivity due to a conductive material, and may be ignited by a discharge occurring at one end in the longitudinal direction of the wick by an electrical stimulus (voltage or the like) applied to the wick. Therefore, there is no need for a separate ignition mechanism, and there is no need for a user to directly ignite the wick, such that the auto-ignition candle is significantly safe, and the user may ignite a candle only by controlling whether to apply electric stimulation, such that use of the auto-ignition candle is significantly convenient.

The conductive material may include one or two or more selected from a conductive carbon material, a conductive polymer, and metal, but it is not particularly limited as long as the object of the present invention is achieved.

As a specific example, the conductive carbon material may be one or two or more selected from carbon fiber, activated carbon, carbon nanotube, graphite, carbon black, graphene, reduced graphene oxide, and a carbon composite material, but the conductive carbon material is not particularly limited as long as the object of the present invention may be achieved.

As a more specific example, the carbon fiber may be one or two or more selected from rayon based carbon fiber, polyacrylonitrile (PAN) based carbon fiber, pitch based carbon fiber, and the like, but is not limited thereto. In addition, the carbon composite material may be a material obtained by increasing mechanical strength of an existing carbon fiber. As an example, the carbon composite material may be a carbon (C)-carbon (C) composite material of which strength is increased by impregnating and carbonating carbon fiber in a phenolic resin to thereby be graphitized at a high temperature of 1000 to 2500° C.

In addition, the conductive polymer may be a polymer in which an electron and/or a hole may move. As a specific example, the conductive polymer may be one or two or more selected from polyacetylene based polymers, polyaniline based polymers, polypyrrole based polymers, polythiophene based polymers, and the like, but is not limited thereto.

As a more specific example, the conductive polymer may be one or two or more selected from polyacetylene (PA), polyaniline (PANI), polypyrrole (PPy), polythiophene (PT), poly(3,4-ethylenedioxythiophene) (PEDOT), polyisothianaphthene (PITN), polyphenylene vinylene (PPV), polyphenylene (PPE), polyphenylene sulfide (PPS), polysulfur nitride (PSN), and the like.

In addition, since the metal itself is a good conductor, any metal may be used without particular limitation, but it is preferable that the metal is a metal having a melting temperature (Tm) of 150 to 500° C. It is preferable that vapor of the metal volatilized during the combustion is not harmless to the human body. In this regard, the metal may be preferably zinc or tin which may be vaporized within a flame temperature and be safe during combustion, but is not limited thereto.

As described above, the conductive material may be the conductive carbon material, the conductive polymer, the metal, or a mixture thereof, or a composite composed of conductive materials different from each other.

The composite as described above may have a structure in which first and second conductive materials are simply mixed with each other, a core shell structure in which a shell made of a second conductive material encloses a core made of a first conductive material, a structure in which a second conductive material is loaded or embedded in a matrix made of a first conductive material, a structure in which a second conductive material is coated or loaded in a first conductive material having a zero-dimensional structure (particles, or the like), a one-dimensional structure (wires, or the like), or a two-dimensional structure (films, or the like), or a stacking structure (including a laminate of particles) in which first and second conductive materials are laminated while forming layers, respectively, but is not limited thereto.

It is advantageous that the conductive material includes the carbon material and/or the metal. Since the carbon material and the metal are excellent conductors and are vaporized without ashes at the time of combustion, the carbon material and the metal are preferable. Further, in the case where the conductive material is the conductive carbon material, the carbon material is entirely directly vaporized into carbon dioxide during the combustion of the wick, thereby making it possible to significantly prevent soot or ash from being generated. Therefore, it is more advantageous that the conductive material is the conductive carbon material.

The wick of the wick portion 10 may include a conductive member. In detail, the wick may include a conductive member containing a conductive material. At this time, the wick may have conductivity in a longitudinal direction of the wick by the conductive member.

A physical size and shape of the conductive member may be suitably adjusted in consideration of a shape or size of a designed candle so as to form a flame having an aesthetically excellent shape and be advantageous for discharge.

From a macroscopic point of view, the conductive member may have a plate shape, a strip shape, a flat plate strip shape, a wire shape, a bar shape, a hollow pillar shape, or the like. In this case, a cross-section (a cross-section perpendicular to the length direction) of a bar-shaped conductive member may have a circular shape, an oval shape, or a polygonal shape ranging from triangular to octagonal shapes, and a cross-section of a hollow pillar-shaped conductive member may have a circular loop shape, an oval loop shape, or a polygonal loop shape ranging from triangular to octagonal loop shapes, but the present invention is not limited thereto.

However, the conductive member has a flat one surface such as in the flat plate strip shape, which is advantageous in that an opposing area in which a discharge may occur is wide.

In addition, the wick of the wick portion 10 may also be configured to further include a non-conductive member (insulating member) coupled to a conductive member.

The non-conductive member may be a combustible non-conductive member, and be coupled to the conductive member, such that the non-conductive member may also serve as a heat transfer barrier preventing heat from being transferred from the conductive member to the fuel while serving as a supporter physically supporting the conductive member.

The non-conductive member may have a shape corresponding to the conductive member, but is not limited thereto. The non-conductive member has a plate shape, a strip shape, a flat plate strip shape, a wire shape, a bar shape, a hollow pillar shape, or the like, independently of the conductive member. In this case, a cross-section (cross-section perpendicular to a length direction) of a bar-shaped non-conductive member may have a circular shape, an oval shape, or a polygonal shape ranging from triangular to octagonal shapes, and a cross-section of a hollow pillar-shaped non-conductive member may have a circular loop shape, an oval loop shape, or a polygonal loop shape ranging from triangular to octagonal loop shapes, but the present invention is not limited thereto.

However, it is preferable that the non-conductive member has a length corresponding to a length of the conductive member coupled thereto, or a relatively shorter length than that of the conductive member.

As the non-conductive member, any material may be used as long as it is combustible and does not generate a toxic material to the human body at the time of combustion.

The first communication unit 20 may communicate with a user terminal 200 in a wired or wireless manner to receive an ignition or fire extinguishing control signal of the auto-ignition candle 100 through the terminal 200, and the control unit 30 may control the ignition state of the wick portion 10 according to the control signal received through the first communication unit 20.

In this case, the control signal means an ignition state of the auto-ignition candle 100 to be controlled through an input (manipulation) of the terminal 20 carried on the external user.

The control signal will be described later in detail.

The ignition means 40 means a means for generating a discharge by applying a discharge voltage to the wick so that the wick portion 10 is ignited according to the control of the control unit 30 and may generate at least one of an arc discharge, a spark discharge, a corona discharge, and a glow discharge to ignite the wick portion 10.

The wick portion 10 is automatically ignited by applying a voltage to the electrode through the discharge which is generated by the ignition means 40.

Therefore, there is no need for a user to directly ignite the wick of the candle, such that the auto-ignition candle is significantly safe, and the user may ignite a candle only by controlling whether to apply electric stimulation by the manipulation of the terminal 200, such that the use of the auto-ignition candle is significantly convenient.

At this time, the control system of the remote controllable auto-ignition candle according to an exemplary embodiment of the present invention determines that the control of the auto-ignition candle by the arc discharge is the most preferable. Hereinafter, the auto-ignition by the 'arc discharge' will be mostly described.

The arc discharge means that when a high frequency voltage is instantly applied to positive and negative electrodes connected to each other, a discharge is generated between the two electrodes to generate a plasma flame.

The auto-ignition candle 100 according to an exemplary embodiment of the present invention uses the plasma flame generated by allowing the ignition means 40 to generate the arc discharge, thereby generating a flame at the wick of the wick portion 10.

To this end, it is preferable that the auto-ignition candle 100 may further include an electrode positioned at a lower end of the wick and electrically connected to the wick.

It is preferable that the two or more wicks configuring the wick portion 10 of the auto-ignition candle 100 are disposed to face each other. If the wicks face each other in a face-to-face manner, the area where the discharge may be generated is widened, such that the probability of the arc discharge may be increased. Also, since the flame ignited by the arc discharge is generated at two or more wicks, the size of the flame may be suitably increased.

Figure 2:
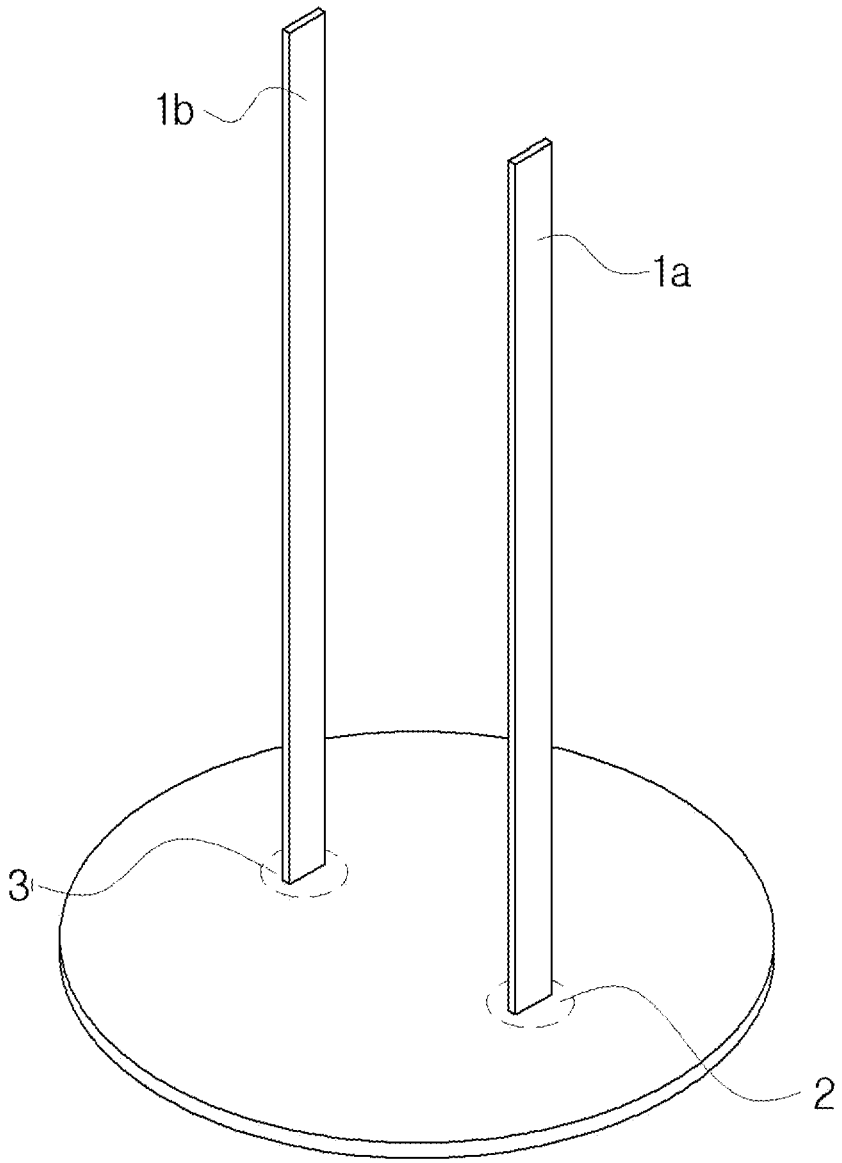
FIGS. 2 to 9A to 9D are diagrams illustrating a wick portion included in a remote controllable auto-ignition candle according to an exemplary embodiment of the present invention.
Figure 4:
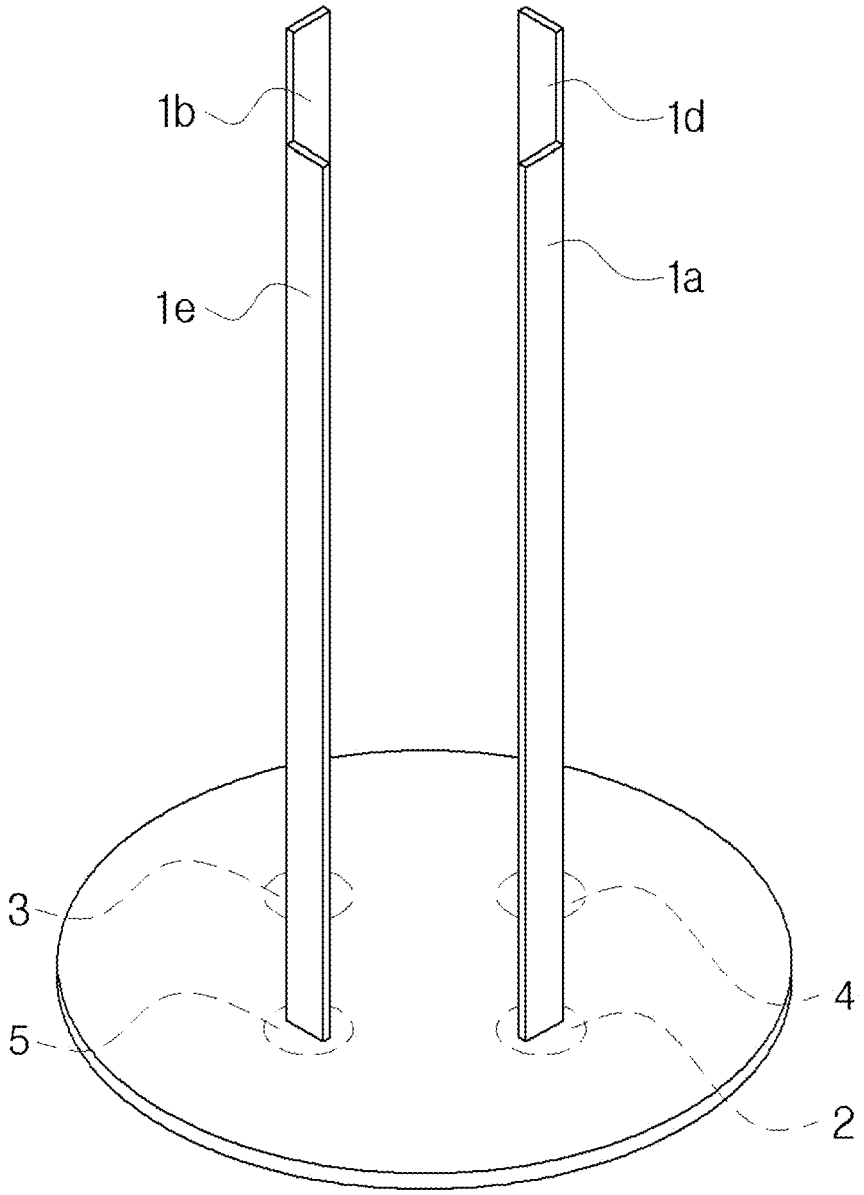
Figure 5:
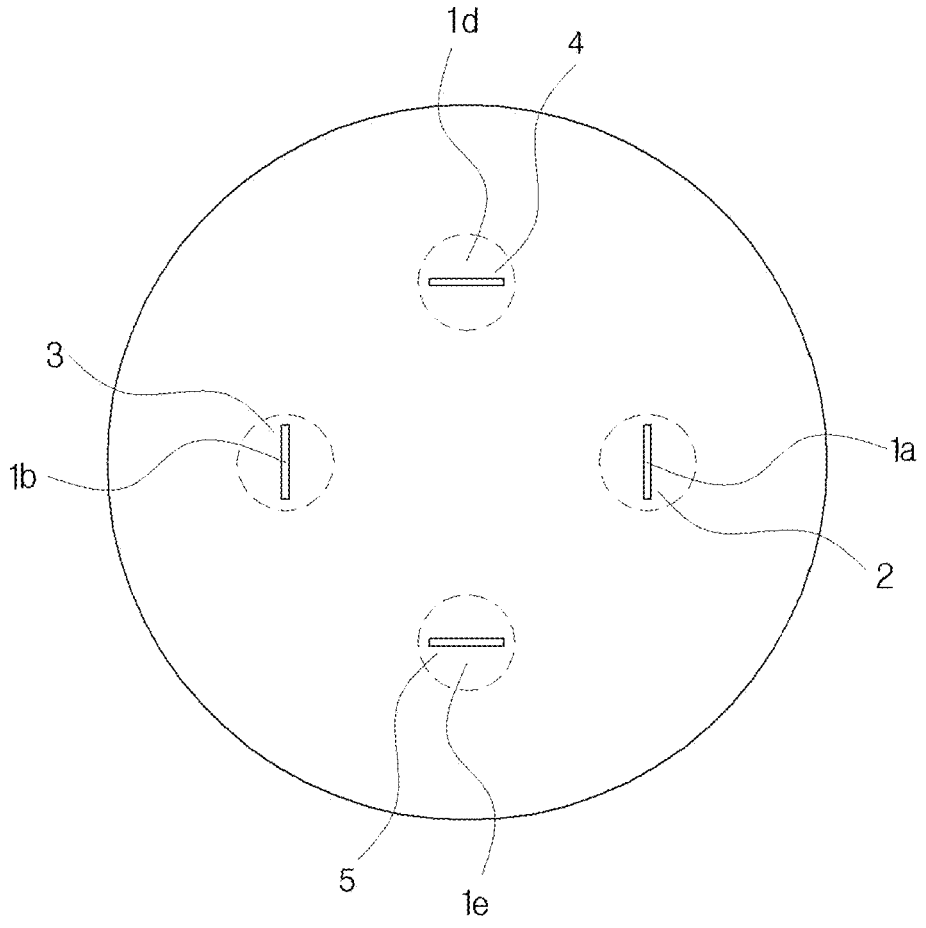

As illustrated in FIGS. 2, 4 and 5, if the number of the wicks 1 configuring the wick portion 10 is an even number, it is preferable that electrodes connected to electrodes having different polarities are positioned so as to face each other while being adjacent to each other. In this case, the arc discharge may be generated at upper ends of wicks facing each other to generate the ignition. In FIG. 2, two wicks 1*a* and 1*b* are configured to be connected to electrodes having different polarities, such that two wicks 1*a* and 1*b* are positioned to face each other.

Further, as illustrated in FIGS. 4 and 5, if four wicks 1*a*, 1*b*, 1*d*, and 1*e* are configured, it is preferable that two ignition means circuits are configured to allow wicks positioned to face each other to be connected to electrodes having different polarities, such that the arc discharge is generated at each pair of wicks to ignite the wicks, or a switch is coupled to one ignition means circuit to apply a discharge voltage to each pair of wicks with a time difference, such that the arc discharge is independently generated at each pair of wicks by a timing control to ignite the wicks. However, the circuit for applying the discharge voltage to each pair of wicks by the ignition means is not limited thereto.

In addition, in FIGS. 4 and 5, the case where the wick portion includes four wicks 1*a*, 1*b*, 1*d*, and 1*e* is described by way of example. However, if the number of wicks is an even number, the ignition means circuit may be controlled in the above-described manner to ignite the wick.

Figure 3:
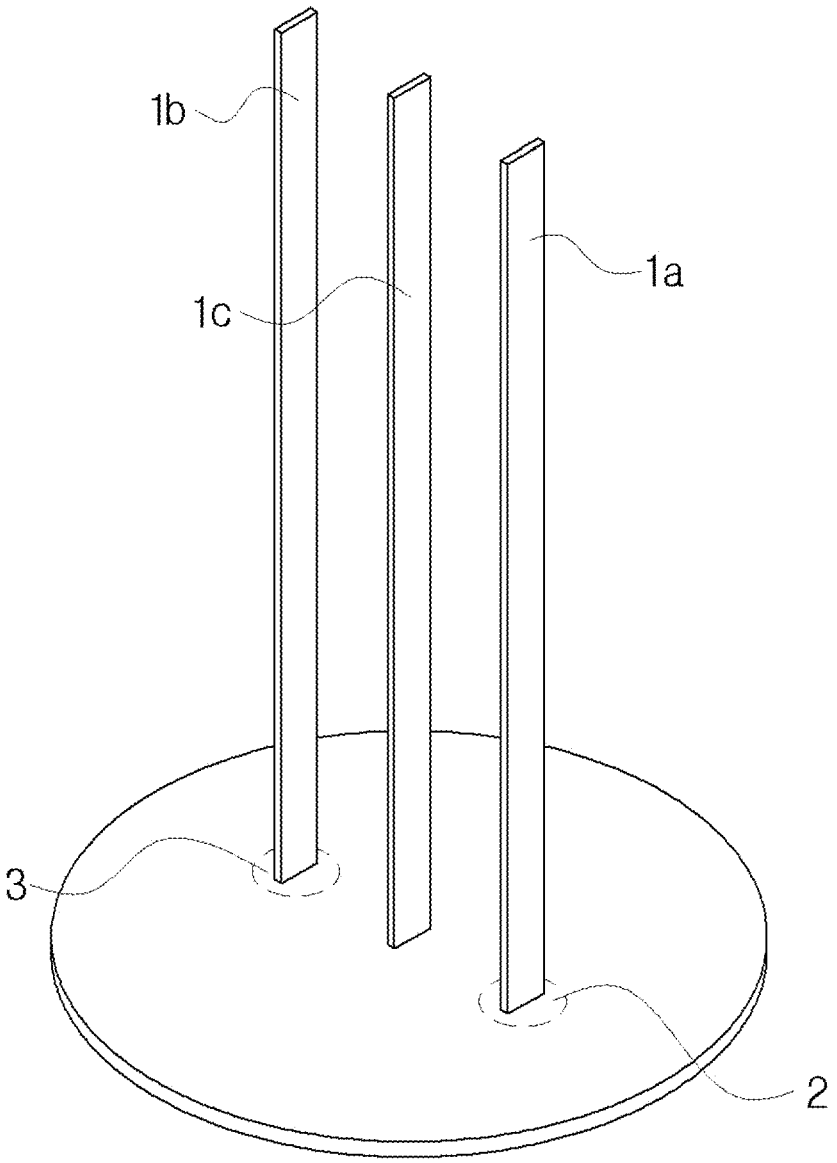
Figure 6:
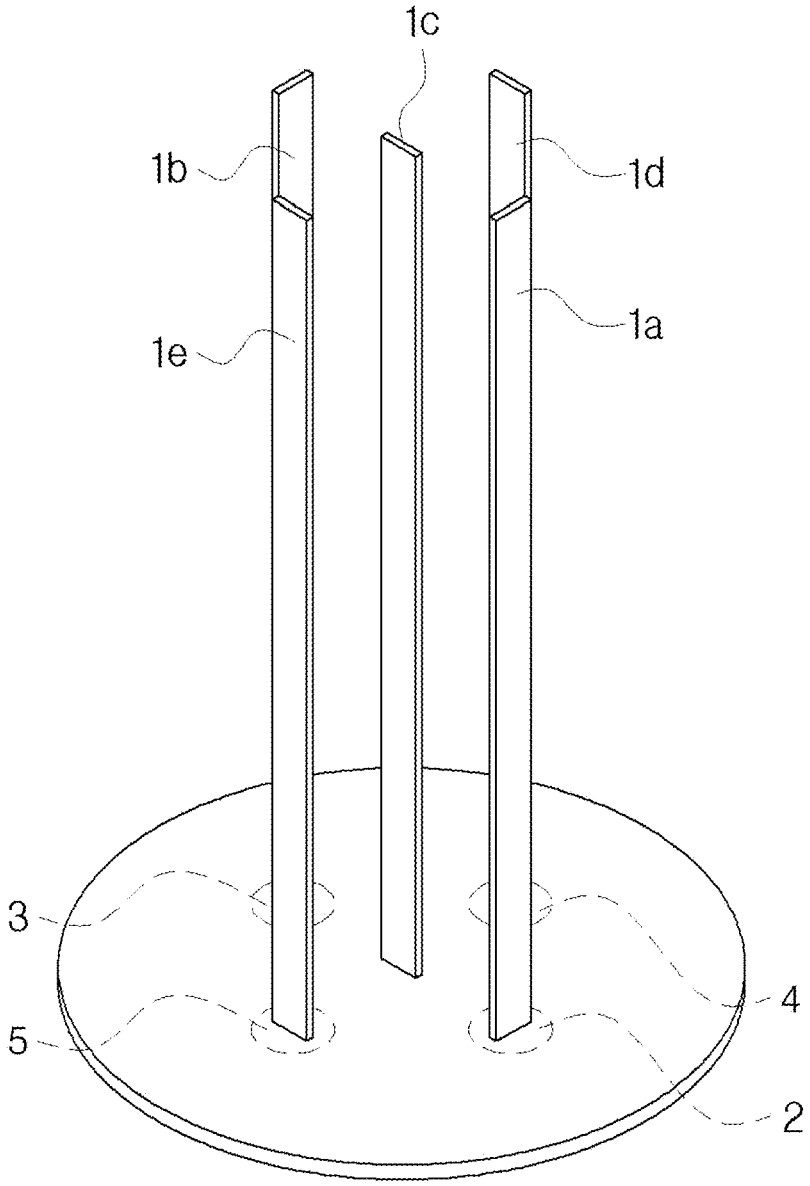
Figure 7:
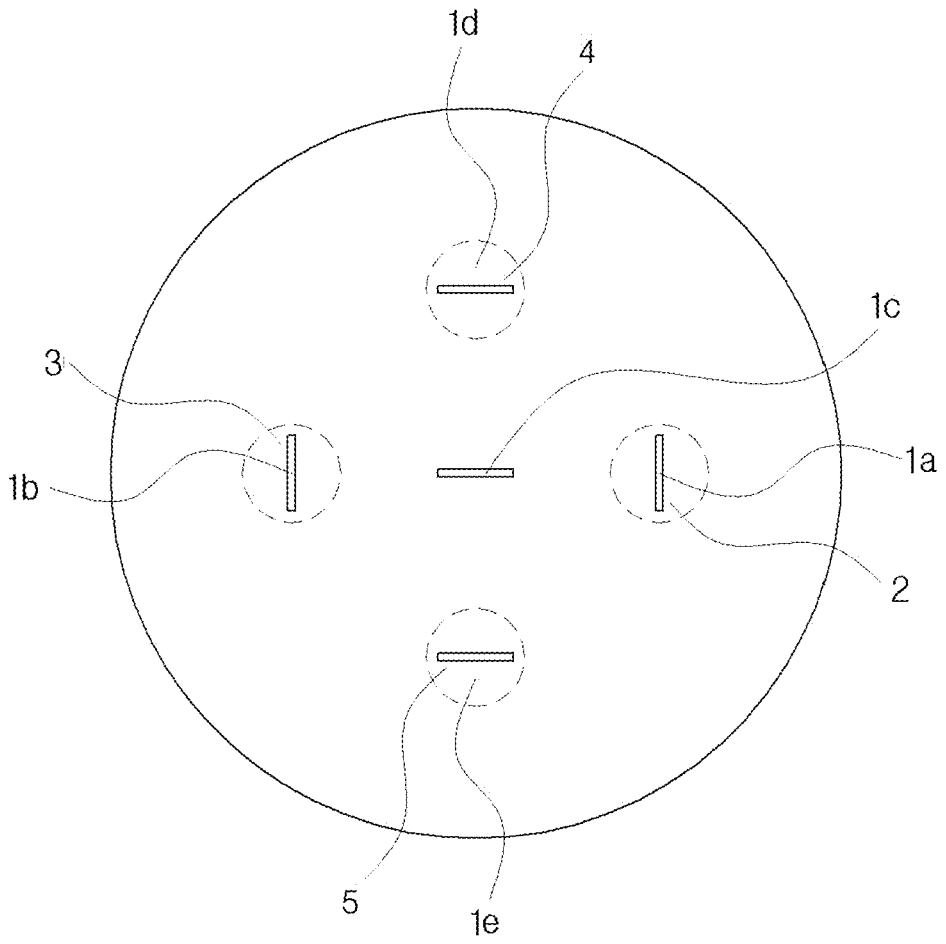

In addition, as illustrated in FIGS. 3, 6 and 7, if the number of the wicks 1 configuring the wick portion 10 is an odd number, it is preferable that wicks connected to electrodes having different polarities are positioned to face each other while being adjacent to each other and one wick 1 without a pair is not connected to an electrode and is positioned between a pair of wicks connected to electrodes.

In other words, it is preferable that wicks connected to electrodes having different polarities are formed in pair and positioned to face each other while being adjacent to each other and thus the arc discharge is generated at upper ends of the wicks facing each other to ignite the wicks and it is preferable that one wick without a pair is not connected to an electrode and is positioned between a pair of wicks connected to electrodes not to generate the direct arc discharge.

However, one wick without a pair that is not connected to the electrode may be positioned between a pair of wicks connected to electrodes having different polarities to be ignited by the indirect arc discharge, such that the brightness of the candle may be controlled.

That is, one wick without a pair that is not connected to an electrode is positioned between a pair of wicks connected to electrodes having different polarities to perform a mediation role of generating the discharge between a pair of wicks connected to electrodes having different polarities. As a result, a gap between a pair of wicks connected to electrodes having different polarities may be increased, and thus the size of the flame may be increased.

Specifically, as illustrated in FIG. 3, if three wicks 1*a*, 1*b*, and 1*c* are configured, it is preferable that the wicks 1*a* and 1*b* positioned to face each other are connected to electrodes having different polarities to generate the arc discharge at the upper ends of the wicks facing each other so that the wicks 1*a* and 1*b* are ignited and one wick 1*c* without a pair is not connected to the electrode so that the direct arc discharge is not made but the indirect arc discharge is made. In addition, the mediation of the arc discharge is made through one wick 1*c* without a pair, and thus the gap between the wicks 1*a* and 1*b* facing each other may be widened.

As illustrated in FIGS. 6 and 7, if five wicks 1*a*, 1*b*, 1*c*, 1*d*, and 1*e* are configured, it is preferable that the wicks 1*a* and 1*b* and 1*d* and 1*e* positioned to face each other are connected to electrodes having different polarities to generate the arc discharge at the upper ends of the wicks facing each other so that the wicks 1*a* and 1*b* and 1*d* and 1*e* are ignited and one wick 1*c* without a pair is not connected to the electrode so that the direct arc discharge is not made but the indirect arc discharge is made.

Thereby, one wick 1*c* without a pair that is not connected to the electrode is positioned between pairs of wicks 1*a* and 1*b* and 1*d* and 1*e* connected to electrodes having different polarities to perform a mediation role of generating the discharge between the wicks 1*a* and 1*b* and 1*d* and 1*e* connected to the electrodes having different polarities. As a result, a gap between a pair of wicks connected to electrodes having different polarities may be increased, and thus the size of the flame may be increased.

In this case, as described above, if four wicks 1*a*, 1*b*, 1*d*, and 1*e* forming each pair are configured, it is preferable that two ignition means circuits are configured to allow wicks positioned to face each other to be connected to electrodes having different polarities, such that the arc discharge is independently generated at each pair of wicks to ignite the wicks, or a switch is coupled to one ignition means circuit to apply a discharge voltage to each pair of wicks with a time difference, such that the arc discharge is generated at each pair of wicks by a timing control to ignite the wicks. However, the circuit for applying the discharge voltage to each pair of wicks by the ignition means is not limited thereto.

In addition, in FIGS. 6 and 7, the case where the wick portion includes four wicks 1*a*, 1*b*, 1*d*, and 1*e* and one wick 1*c* not connected to the electrode is described by way of example. However, if the number of wicks is an odd number, the ignition means circuit may be controlled in the above-described manner to ignite the wick.

Figure 8:
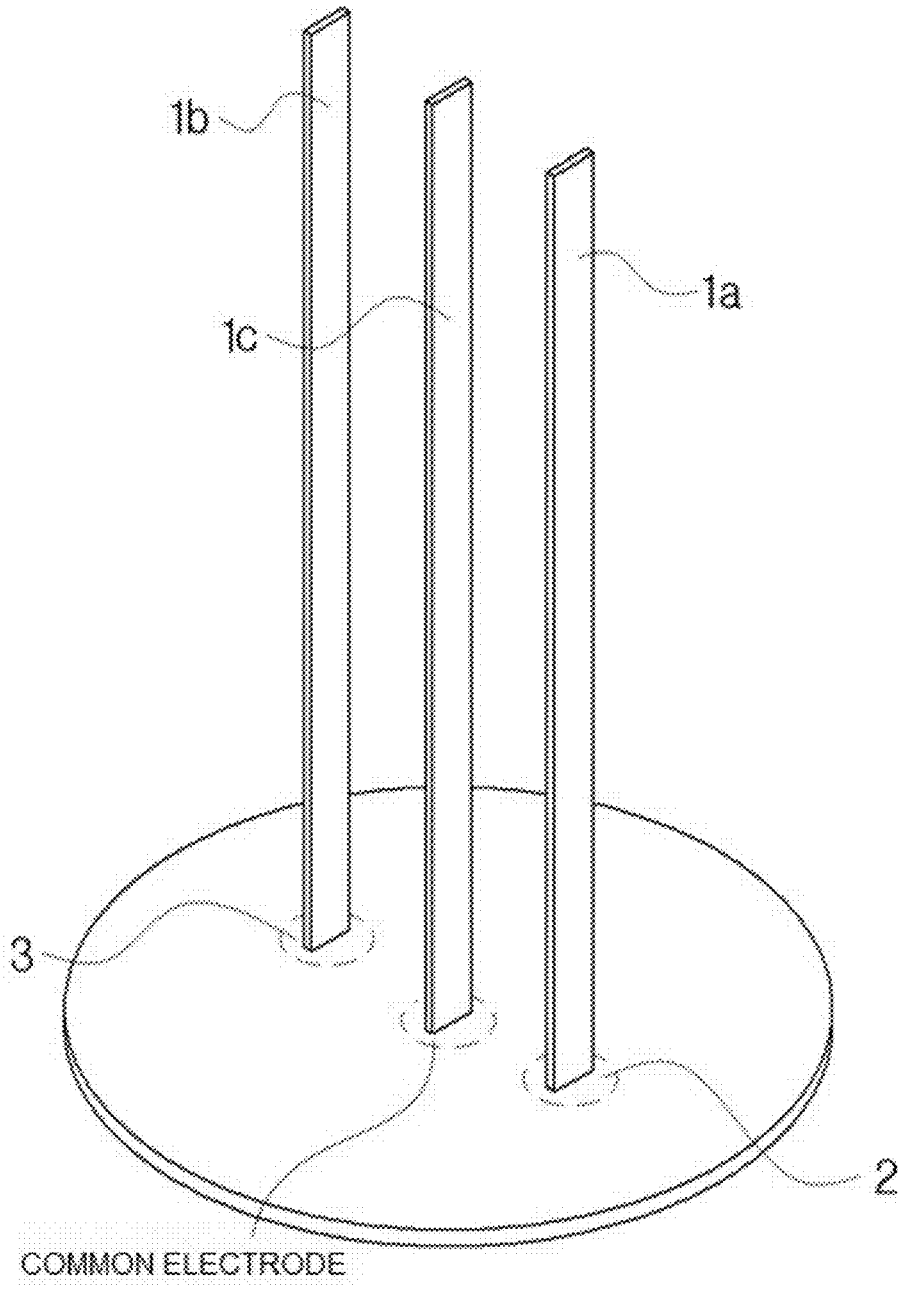

As another example, as illustrated in FIG. 8, if the number of wicks 1 configuring the wick portion 10 is an odd number, a common electrode may be connected to one wick 1, and an electrode having polarity different from that of the common electrode may be connected to at least one wick 1 to which the one wick 1 is adjacent.

Figures 9, 9A, 9B, 9C, 9D:
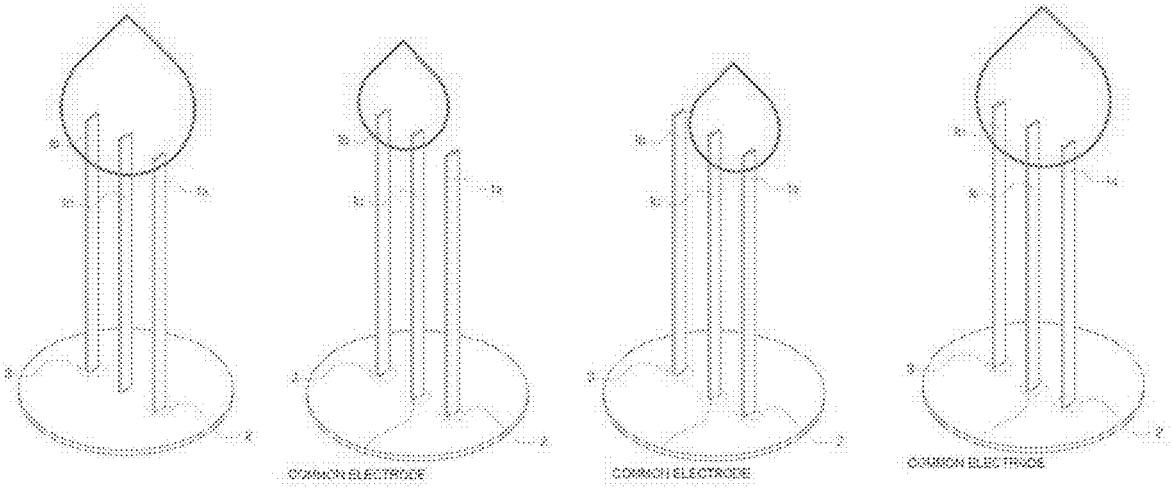

Describing in more detail, as illustrated in FIGS. 9A to 9D, if the number of wicks 1 configuring the wick portion 10 is an odd number, as illustrated in FIG. 9A, an electrode may not be connected to one wick 1*c* without a pair or as illustrated in FIGS. 9B to 9D, the common electrode may be connected to one wick 1*c* without a pair.

As illustrated in FIG. 9A, if an electrode is not connected to one wick 1*c* without a pair, the indirect arc discharge may be generated via one wick 1*c* without a pair while the ignition is generated by the arc discharge between another pair of wicks 1*a* and 1*b* connected to electrodes.

In this case, as described above, the gap between another pair of wicks 1*a* and 1*b* connected to the electrodes may be widened enough to generate the arc discharge based on the mediation, such that the flame size of the auto-ignition candle 100 becomes larger and the brightness becomes relatively higher.

In another case, as illustrated in FIGS. 9B to 9D, if the common electrode is connected to one wick 1*c* without a pair and electrodes having polarities different from that of the common electrode are connected to the other two wicks 1*a* and 1*b*, the operation of the ignition means 40 is controlled according to the control of the control unit 30 to adjust the position, number, and shape of flames of the auto-ignition candle 100.

That is, according to the control of the operation of the ignition means 40, the discharge may be generated at the wick 1*a* or 1*b* connected to the electrodes having polarities different from that of the wick 1*c* connected to the common electrode and thus the ignition may be generated, or the arc discharge may be generated at each of the wicks 1*a* and 1*b* different from the wick 1*c* connected to the common electrode and thus the ignition may also be generated.

Accordingly, as illustrated in FIGS. 9B to 9D, the position, number, and shape of flames of the auto-ignition candle 100 may be adjusted.

A circuit configuration applicable to the case where one of three wicks is connected to the common electrode will be described below.

First of all, two ignition means circuits for providing a discharge voltage to each of the other two wicks 1*a* and 1*b* may be configured for the wick 1*c* connected to the common electrode. In this case, one electrode having the same polarity may be selected from the electrodes of the two ignition means circuits to be set as a common electrode, the common electrode may be connected to one wick without a pair, and the electrodes that are not set as the common electrode among the electrodes of the two ignition means circuits are connected to two different wicks to control the application of the discharge voltage through the two ignition means circuits, such that the position, number, and shape of wicks where the discharge is generated may be selected.

As another example, the switch may be connected to one ignition means circuit so that one selected electrode in one ignition means circuit is set as the common electrode and connected to one wick without a pair and the electrodes that are not set as the common electrode control the switch to be connected to two different wicks. At this time, the electrodes connected to the two wicks may select a wick to which the discharge voltage is applied through the switch, such that the position, number, and shape of wicks where the discharge is generated may be selected.

In addition, in FIGS. 8 and 9, a circuit configuration for applying a discharge voltage to a wick in the case where the wick portion includes two wicks 1*a* and 1*b* and one wick 1*c* connected to the common electrode is described by way of example. However, if the number of wicks is an odd number and one of the wicks is connected to the common electrode, it is possible to configure the ignition means circuit in such a manner to ignite the wick.

In the present invention, the "opposing" means that at least two wicks necessarily face each other. At this time, even if cut surfaces of the wicks have directivity, it does not mean that the directions of the cut surfaces of the wicks face each other in the same direction, and if the discharge may be generated at the wick, when the directions of the cut surfaces of the wicks are different from each other but the wicks are positioned to be adjacent to each other, it may mean that the wicks may face each other.

In addition, the auto-ignition candle 100 according to an exemplary embodiment of the present invention preferably further includes a sensor unit 50.

The sensor unit 50 may detect the temperature or light of the wick portion 10 or a gas concentration around the candle to determine an ignition state of the auto-ignition candle 100, i.e., an ignition state of the wick portion 10.

In detail, the control unit 30 may determine the ignition state of the ignition portion 10 according to the degree of the temperature and light that the sensor unit 50 detects.

If it is determined that the detected gas concentration is equal to or higher than a preset reference value according to the gas concentration around the candle sensed by the sensor unit 50, a warning message may be notified to the terminal 200 or an alarm may be issued thereto.

The sensor unit 50 may include one or two or more selected from a thermocouple, a metal thermometer, a thermistor, an integrated circuit (IC) temperature sensor, a magnetic temperature sensor, a thermopile, a pyroelectric temperature sensor, and the like that can detect a temperature, but is not particularly limited thereto as long as the object of the present invention can be achieved.

Further, the sensor unit 50 may include an ultraviolet sensor, an infrared sensor, and a visible light sensor that can detect light, and is not particularly limited thereto as long as the object of the present invention can be achieved.

The sensor unit 50 may be positioned on an upper end of a case enclosing the candle, or attached to the electrode at a lower end of the wick or the case, but is not limited thereto.

In addition, the auto-ignition candle 100 according to the exemplary embodiment of the present invention may be configured to further include a power supply unit 60 that supplies operating power to the control unit 30, the ignition means 40, and a first communication unit 20.

The power supply unit 60 may be supplied with power from the outside in a wired manner to supply the operating power to the control unit 30, the ignition means 40, and the first communication unit 40.

Alternatively, the power supply unit 60 may also include a battery to supply the operating power.

In this case, when the battery is a secondary battery that may be recharged to be reused, the battery may be charged in a wired or wireless manner to supply operating power to the control unit 30, the ignition means 40, and the first communication unit 40.

As illustrated in FIG. 1, the terminal 200 for controlling the auto-ignition candle 100 in a wired or wireless manner may be configured to include an input unit 210 and a second communication unit 220.

The terminal 200 may preferably be any one of a remote control unit, a mobile phone, a smart phone, a tablet PC, a smart watch, a wearable device, a notebook computer, or a personal computer (PC).

In detail, the input unit 210 may receive control information (control signal) for an ignition control of the auto-ignition candle 100 from a user, and may use an interactive interface previously stored in the terminal 200 to derive control information for the ignition control of the auto-ignition candle 100 based on characters received from the user.

In more detail, the interactive interface refers to a commonly used interactive interface 'chatbot' or the like, and may derive the control information for the ignition control of the auto-ignition candle 100 based on the characters received from an external user.

It is possible to derive the control information for the ignition control of the auto-ignition candle 100 by executing the pre-stored interactive interface through the input unit 210 of the terminal 200. For example, if the user inputs 'turn on first and third candles' using the terminal 200, the input unit 210 of the terminal 200 may derive 'ignition-on control information of the first candle' and 'ignition-on control information of the third candle' based on the characters received from an external user and transmit the derived information to the auto-ignition candle 100 so that the actual ignition may be made.

The second communication unit 220 may transmit the control information received from the input unit 210 to the auto-ignition candle 100.

That is, the second communication unit 220 transmits the control information received from the input unit 210 to the first communication unit 20 of the auto-ignition candle 100, and the first communication unit 20 transmits the control information to the control unit 30 to control the ignition state of the wick portion 10.

At this time, the control information preferably includes at least one selected from an ignition on/off control of the auto-ignition candle 100, a brightness control, an ignition time control, an ignition pattern control of the wick portion 10, and a selection control of the auto-ignition candle 100.

According to the exemplary embodiment of the present invention, if the auto-ignition candle 100 receives the control information regarding the ignition-on control from the terminal 200, that is, if the control information regarding the ignition-on control of the auto-ignition candle 100 is input from the user through the input unit 210, the control unit 30 of the auto-ignition candle 100 may control the ignition means 40 to control the ignition of the wick of the wick portion 10.

That is, the control unit 30 may control the discharge of the ignition means 40 to control the ignition of the wick of the wick portion 10.

Figure 12:
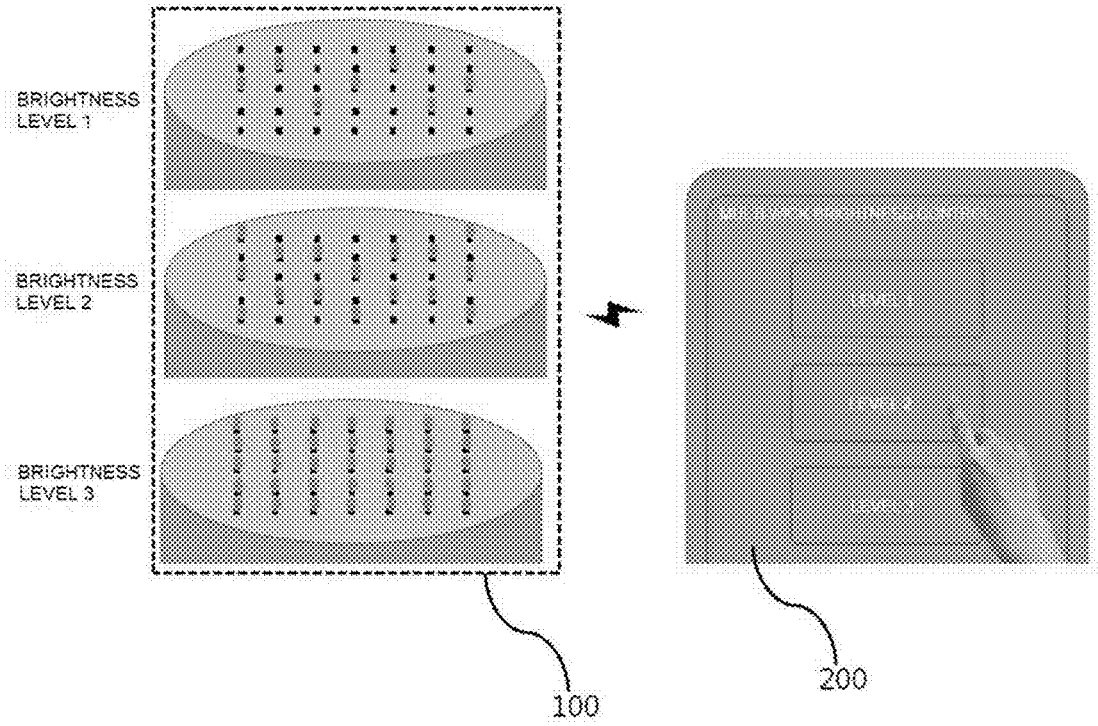
FIGS. 12 to 14 are diagrams illustrating a control method using a terminal included in a control system of a remote controllable auto-ignition candle according to an exemplary embodiment of the present invention.

According to the exemplary embodiment of the present invention, as illustrated in FIG. 12, if the auto-ignition candle 100 receives the control information regarding the brightness control from the terminal 200, that is, if the control information regarding the brightness control of the auto-ignition candle 100 is input from the user through the input unit 210, the control unit 30 of the auto-ignition candle 100 may control the ignition means 40 to control the number of wicks at which the ignition is made.

At this time, since two wicks per unit flame are required, in order to control the brightness of the auto-ignition candle 100, the wick portion 10 preferably includes three or more wicks spaced apart from each other.

Since the auto-ignition candle 100 includes three or more wicks as described above, the number of wicks to be ignited may be controlled to control the brightness degree.

As a result, the control unit 30 of the auto-ignition candle 100 may control the discharge of the ignition means 40 according to the received control information regarding the brightness control to control the number of wicks to be ignited of the wick portion 10, thereby controlling the brightness information of the candle. In this case, it is preferable that the number of wicks to be ignited is set in advance according to the total number of wicks.

Figure 13:
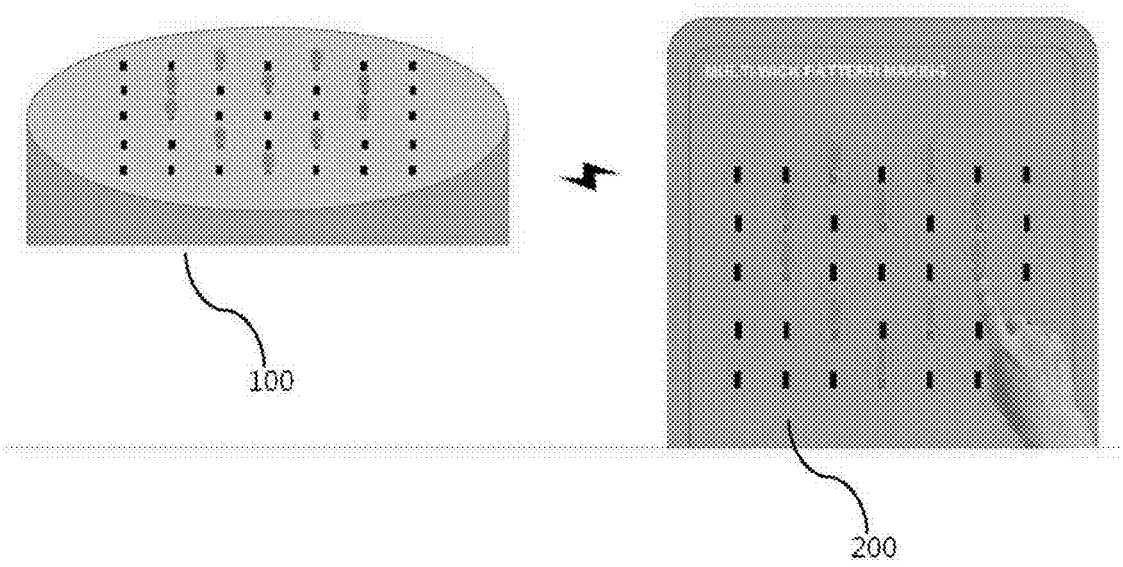

According to the exemplary embodiment of the present invention, as illustrated in FIG. 13, if the auto-ignition candle 100 receives the control information regarding an ignition pattern control of the wick portion 10 from the terminal 200, that is, if the control information regarding the ignition pattern control of the auto-ignition candle 100 is input from the user through the input unit 210, the control unit 30 of the auto-ignition candle 100 may control the ignition means 40 to control the ignition pattern of the wick of the wick portion to be ignited.

At this time, since two wicks per unit flame are required, in order to control the brightness of the auto-ignition candle 100, the wick portion 10 preferably includes three or more wicks spaced apart from each other.

Since the auto-ignition candle 100 includes two or more wicks as described above, the ignition state of the wick may be controlled by the connection between different electrodes.

By doing so, the control unit 30 of the auto-ignition candle 100 may control the discharge of the ignition means 40 according to the control information regarding the control of the received ignition pattern to control the ignition state of the wick portion 10 and may further control even the position of the wick 1 to be ignited. At this time, it is preferable that the position of the wick to be ignited is set in advance according to the total number of wicks and the form in which the wick is disposed.

Figure 14:
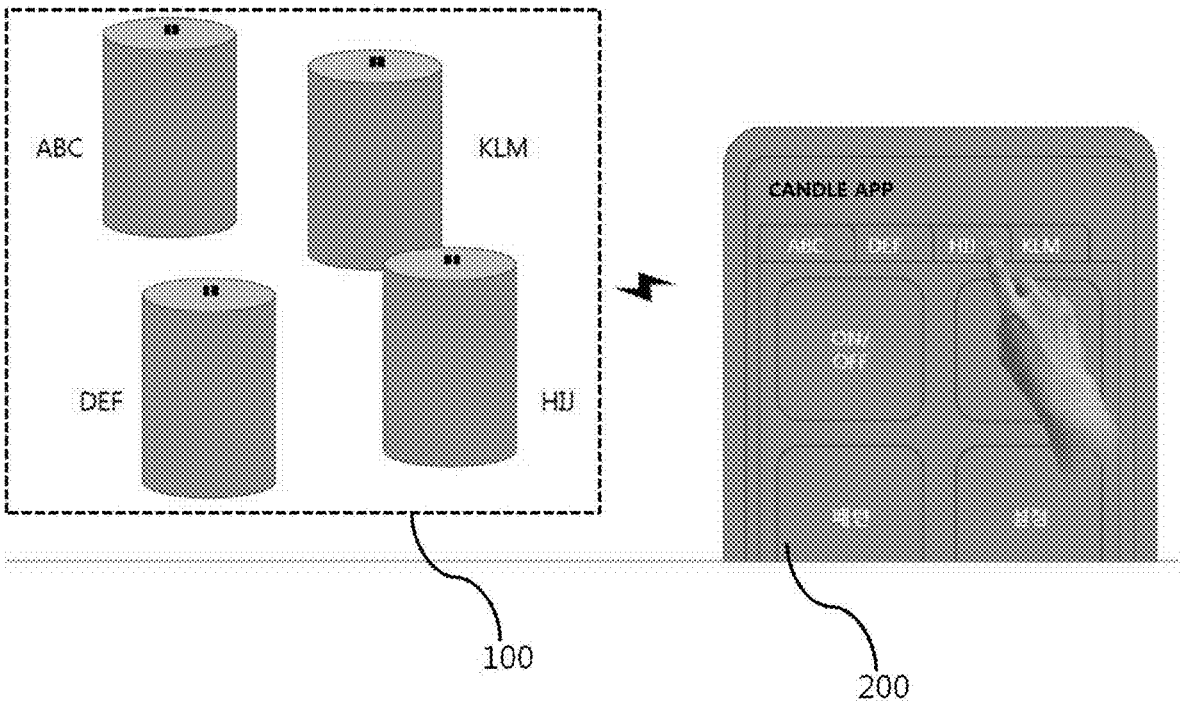

According to the exemplary embodiment of the present invention, as illustrated in FIG. 14, the case where the auto-ignition candle 100 receives the control information regarding the selection control of the auto-ignition candle 100 from the terminal 200 will be described.

At this time, it is preferable that the number of auto-ignition candles 100 controlled by the terminal 200 in a wired or wireless manner is limited to a plurality. In addition, the embodiment illustrated in FIG. 14 means the case where at least one of the plurality of auto-ignition candles receives the control information regarding the selection control of the auto-ignition candle from the terminal 200, that is, the case where the specific auto-ignition candle 100 to be ignited is selected from the user through the input unit 210 of the terminal 200 and the control information regarding the selection control is input.

The control unit 30 of the at least one auto-ignition candle 100 receiving the control information regarding the selection control of the auto-ignition candle from the user controls the ignition means 40 to control the ignition of the wick of the wick portion 10.

In this case, the control information regarding the selection control of the auto-ignition candle that may be received from the user may include the 'ignition on or off control, brightness control, ignition time control, ignition pattern control of the wick portion, or the like', and the ignition state of at least one auto-ignition candle that the user wants among the plurality of auto-ignition candles may be controlled.

Here, the number of auto-ignition candles that the user may select may be changed depending on the number of candles connected to the entire control system.

As illustrated in FIGS. 12 to 14, the terminal 200 may control the ignition state of the auto-ignition candle 100 based on the control information input by executing the control program of the auto-ignition candle that has been installed in advance.

The control program may display and provide the form in which the wicks 1 of each wick portion 10 of one or more auto-ignition candles 100 is disposed and the user may select the positions of the wicks based thereon.

That is, the ignition pattern control of the wick portion 10 may be performed by selecting the position of the wick to be ignited by the user in the from displayed and provided through the control program.

In addition, the input unit 210 of the terminal 200 may further receive status request information for monitoring the ignition state of the auto-ignition candle 100 from a user.

When receiving the status request information from the terminal 200, the auto-ignition candle 100 may transmit the status information on the ignition state of the wick of the wick portion 100 to the terminal 100. At this time, the status information regarding the ignition state of the wick of the wick portion 100 may be determined by the sensor unit 50.

In addition, the remote controllable auto-ignition candle according to the exemplary embodiment of the present invention may be configured to further include a fire extinguishing means 70.

The fire extinguishing means 70 is a means for extinguishing the ignited wick. When the control information regarding the ignition off control is received from the terminal 200, the fire extinguishing means 70 can control the fire extinguishing of the wick.

Although not illustrated in the drawings, the fire extinguishing means 70 may be configured in a cap form that is a form of directly blocking air for the fire extinguishing of the wick or a form in which it is configured to include a pump and a nozzle to blow outside air into the wick to extinguish the wick, or the like, but the present invention is not limited thereto.

When the fire extinguishing means 70 is configured to include the pump and the nozzle to blow outside air into the wick to extinguish the wick, the outside air means outside air existing at an outer region of the auto-ignition candle 100 or carbon dioxide generated while the auto-ignition candle 100 is ignited, and the outside air is collected and the collected air is supplied to the wick according to the control information so that the wick can be extinguished.

Specifically, if the auto-ignition candle 100 receives the control information regarding the ignition-off control from the terminal 200, that is, if the control information regarding the ignition-off control of the auto-ignition candle 100 is input from the user through the input unit 210, the control unit 30 of the auto-ignition candle 100 may control the fire extinguishing means 70 to control the fire extinguishing of the wick of the wick portion 10.

In addition, if the auto-ignition candle 100 receives the control information regarding the ignition time control from the terminal 200, that is, if the control information regarding the ignition time control of the auto-ignition candle 100 is input from the user through the input unit 210, the control unit 30 of the auto-ignition candle 100 may alternately control the ignition means 40 and the fire extinguishing means 70 to control the ignition time of the wick of the wick portion 10.

In addition, it is preferable that the control unit 30 of the auto-ignition candle 100 controls the ignition means 40 in the moment that the first communication unit 20 communicates with the terminal 200 to start the connection to ignite the wick of the wick portion 10 and the control unit controls the fire extinguishing means 70 in the moment that the connection with the terminal 200 is released to extinguish the wick of the wick portion 10.

By doing so, it is possible to counter an account to increase the stability.

That is, the exemplary embodiment of the present invention relates to the remote controllable auto-ignition candle and the control system thereof capable of easily controlling the ignition state or the fire extinguishing state of the auto-ignition candle including the wick made of the conductive material using the terminal carried on the external user.

According to the above-described structure, the remote controllable auto-ignition candle and the control system thereof remotely control the candle that may be automatically ignited by a discharge, such that the candle may be used very conveniently and may be freely used without the separate ignition mechanism or fire extinguishing mechanism.

In addition, the user may be free from the risk of a burn or the like during the ignition or the fire extinguishing.

Hereinabove, although the present invention has been described by specific matters such as detailed components, exemplary embodiments, and the accompanying drawings, they have been provided only for assisting in the entire understanding of the present invention. Therefore, the present invention is not limited to the exemplary embodiments. Various modifications and changes may be made by those skilled in the art to which the present invention pertains from this description.

Therefore, the spirit of the present invention should not be limited to these exemplary embodiments, but the claims and all of modifications equal or equivalent to the claims are intended to fall within the scope and spirit of the present invention.

What is claimed is:

1. A remote controllable auto-ignition candle, comprising:

a wick portion including at least two wicks spaced apart from each other and two or more electrodes electrically connected to lower ends of the respective wicks, wherein, each of the at least two wicks includes a conductive member made of a conductive material including a conductive carbon material, a conductive polymer, or a mixture thereof, and a combustible non-conductive member, the conductive member is coupled to the combustible non-conductive member, the conductive member and the combustible non-conductive member are configured such that the at least two wicks are ignited directly by a discharge that occurs between the at least two wicks and the discharge is generated at one end in the longitudinal direction of the at least two wicks by a remote control of an electric stimulus applied to the electrodes without a separate fuel or an igniter between the wicks, the non-conductive member is configured to form a heat transfer barrier that prevents heat transfer from the conductive member to a fuel, and to serve as a support for physically supporting the conductive member, the conductive member has a flat surface on which the discharge occurs, the conductive member has a plate shape, a strip shape, a flat plate strip shape, a wire shape, a bar shape, or a hollow pillar shape, the combustible non-conductive member has a shape corresponding to the conductive member and has a length equal to or less than the length of the conductive member, and the combustible non-conductive member is made of combustible material and does not generate toxic substances to a human body during combustion;

a first communication unit communicating with a user terminal in a wired or wireless manner;

a control unit controlling an ignition state of the wick portion according to a control signal received through the first communication unit; and an ignition means applying a discharge voltage to the different electrodes electrically connected to the lower ends of the respective wicks so that the wicks are ignited according to a control of the control unit, wherein if the number of the at least two wicks is an even number, wicks connected to electrodes having different polarities are positioned to face each other while being adjacent to each other, and if the number of the at least two wicks is an odd number, wicks connected to electrodes having different polarities are positioned to face each other while being adjacent to each other, and one wick without a pair is not connected to an electrode and is positioned between a pair of wicks connected to electrodes, or a common electrode is connected to one wick and an electrode having polarity different from that of the common electrode is connected to another at least one other wick adjacent to the one wick, such that the ignition means applies a voltage to generate a discharge to the electrode to which the common electrode is connected.

2. The remote controllable auto-ignition candle of claim 1, wherein the ignition means generates at least one of an arc discharge, a spark discharge, a corona discharge, and a glow discharge.

3. The remote controllable auto-ignition candle of claim 1, further comprising:

a sensor unit detecting temperature or light of the wick portion or detecting a gas concentration around the candle.

4. The remote controllable auto-ignition candle of claim 3, wherein the control unit determines an ignition state of the wick portion according to information of the temperature or light detected by the sensor unit.

5. The remote controllable auto-ignition candle of claim 3, wherein the control unit notifies a warning message to the terminal or issues an alarm thereto if it is determined that the gas concentration detected by the sensor unit is equal to or higher than a predetermined value.

6. A control system of a remote controllable auto-ignition candle, comprising:

at least one auto-ignition candle of claim 1; and the terminal controlling the auto-ignition candle in a wired or wireless manner.

7. The control system of claim 6, wherein the terminal includes:

an input unit receiving control information for an ignition control of the auto-ignition candle from a user; and a second communication unit transmitting the control information received from the input unit to the auto-ignition candle.

8. The control system of claim 7, wherein the control information is at least one of an ignition on/off control of the auto-ignition candle, a brightness control, an ignition time control, an ignition pattern control of the wick portion, and a selection control of the auto-ignition candle.

9. The control system of claim 8, wherein if the auto-ignition candle receives the control information regarding the ignition-on control from the terminal, the control unit of the auto-ignition candle controls the ignition means to control the ignition of the wick.

10. The control system of claim 8, wherein the wick portion includes at least three wicks spaced apart from each other, and if the auto-ignition candle receives the control information regarding the brightness control from the terminal, the control unit of the auto-ignition candle controls the ignition means to control the number of wicks to be ignited.

11. The control system of claim 8, wherein the wick portion includes at least three wicks spaced apart from each other, and if the auto-ignition candle receives the control information regarding the ignition pattern control of the wick portion from the terminal, the control unit of the auto-ignition candle controls the ignition means to control the ignition pattern of the wick of the wick portion to be ignited.

12. The control system of claim 8, wherein the number of auto-ignition candles controlled by the terminal in a wired or wireless manner is plural, and if at least one of the plurality of auto-ignition candles receives the control information regarding the selection control of the auto-ignition candle from the terminal, the at least one auto-ignition candle receiving the control information regarding the selection control of the auto-ignition candle controls the ignition means to perform the ignition-on or off control, the brightness control, the ignition time control, and the ignition pattern control of the wick portion.

13. The control system of claim 8, wherein the input unit uses an interactive interface previously stored in the terminal to derive control information for the ignition control of the auto-ignition candle based on characters received from the user.

14. The control system of claim 8, wherein the control information is received by executing a control program of the auto-ignition candle previously installed in the terminal.

15. The control system of claim 14, wherein the control program displays and provides the form in which the wicks of each wick portion of the at least one auto-ignition candle are disposed, and the ignition pattern control of the wick portion is performed by selecting a position of the wick to be ignited in the form.

16. The control system of claim 7, wherein the input unit further receives status request information for monitoring the ignition state of the auto-ignition candle from the user.

17. The control system of claim 16, wherein if the status request information is received, the auto-ignition candle transmits the status information regarding the ignition state of the wick to the terminal.

18. The control system of claim 8, wherein the auto-ignition candle further includes a fire extinguishing means for extinguishing the ignited wick.

19. The control system of claim 18, wherein if the auto-ignition candle receives the control information regarding the ignition-off control from the terminal, the control unit of the auto-ignition candle controls the fire extinguishing means to control the fire extinguishing of the wick.

20. The control system of claim 18, wherein the control unit of the auto-ignition candle controls the ignition means and the fire extinguishing means to control the ignition time of the wick when the auto-ignition candle receives the control information regarding the ignition time control from the terminal.

21. The control system of claim 7, wherein the terminal communicates with the auto-ignition candle through at least any one of Wi-Fi, Bluetooth, infrared communication, ZigBee, Z-wave, contactless local area communication, mobile network, low power wide area (LPWA), and a local area network (LAN).

22. The control system of claim 18, wherein the control unit of the auto-ignition candle controls the ignition means in the moment that the first communication unit communicates with the terminal to start a connection to ignite the wick and the control unit controls the fire extinguishing means in the moment that the connection with the terminal is released to extinguish the wick.

* * * * *